US005614138A

United States Patent [19]

Yamada et al.

[11] Patent Number: 5,614,138

[45] Date of Patent: Mar. 25, 1997

[54] METHOD OF FABRICATING NON-LINEAR RESISTOR

[75] Inventors: Seiichi Yamada, Juou-machi; Shigeru Tanaka, Hitachi; Moritaka Shoji, Hitachi; Shigehisa Motowaki, Hitachi; Ken Takahashi, Tokai-mura; Shingo Shirakawa, Hitachi; Shinichi Oowada, Hitachinaka; Takeo Yamazaki, Hitachi, all of Japan

[73] Assignee: Hitachi Ltd., Tokyo, Japan

[21] Appl. No.: 384,954

[22] Filed: Feb. 7, 1995

[30] Foreign Application Priority Data

Feb. 10, 1994 [JP] Japan ..... 6-016080

[51] Int. Cl.[6] ..... H01B 1/06

[52] U.S. Cl. ..... 264/61; 264/66; 252/518; 252/519; 501/153

[58] Field of Search ..... 264/61, 63, 65, 264/66; 501/153; 29/610.1, 612; 252/518, 519

[56] References Cited

U.S. PATENT DOCUMENTS

| | | | |
|---|---|---|---|
| 4,692,735 | 9/1987 | Shoji et al. | 338/21 |
| 4,767,729 | 8/1988 | Osman et al. | 501/94 |
| 4,981,624 | 1/1991 | Tsuda et al. | 264/6 |
| 5,004,573 | 4/1991 | Oh et al. | 264/61 |

FOREIGN PATENT DOCUMENTS

| | | |
|---|---|---|
| 0200126 | 11/1986 | European Pat. Off. . |
| 0320196 | 6/1989 | European Pat. Off. . |
| 0322211 | 6/1989 | European Pat. Off. . |
| 55-13124 | 4/1980 | Japan . |
| 58-159303 | 9/1983 | Japan . |
| 58-200508 | 11/1983 | Japan . |
| 59-12001 | 3/1984 | Japan . |

OTHER PUBLICATIONS

Patent Abstracts of Japan, vol.013 No. 437 Sep. 29, 1989 JP1165102.

Patent Abstracts of Japan, vol.014 No. 065 Sep. 29, 1989, JP 283902.

Abstract Database WPI, Section Ch, Week 8415, Derwent Publications, JP59012001, Mar. 19, 1984.

Eur.Srch.Report Feb. 26, 1996 Europe Translation.

*Primary Examiner*—Christopher A. Fiorilla

*Attorney, Agent, or Firm*—Evenson McKeown Edwards & Lenahan, PLLC

[57] ABSTRACT

A mixture of calcinated metallic oxides are mixed with ZnO and $SiO_2$, granulated, compacted and then sintered to form a nonlinear resistor. After sintering, the formed ZnO resistor elements are heat treated, preferably in a two-step heat treating process.

13 Claims, 13 Drawing Sheets

METHOD OF FABRICATING NON-LINEAR RESISTOR

BACKGROUND AND SUMMARY OF THE INVENTION

The present invention relates to a voltage non-linear resistor used mainly in the field of electric power and including a main component of ZnO. The invention also relates to a method of fabricating such a voltage non-linear resistor.

Non-linear resistors made of a main component of ZnO (ZnO element) have an excellent non-linear characteristics and are widely used as elements for arresters. The ZnO element is fabricated by adding a small amount of metallic oxides such as $Bi_2O_3$, $Sb_2O_3$, $MnCO_3$, $Cr_2O_3$, $Co_2O_3$, $B2O_3$, $Al(NO_3)_3$ to a main component of ZnO, mixing and granulating the oxides, compacting the mixture, then sintering and heat-treating the compacted body, the sintered body being provided with an electrode.

Following are definitions of terms used to describe characteristics of ZnO elements of the type contemplated by the present invention:

LIMITING VOLTAGE: A terminal voltage of a ZnO element when current n A flows through the element.

FLATNESS: A ratio of a terminal voltage ($V_{5kA}$) of a ZnO element when current of 5000 A flows through the element to a terminal voltage ($V_{1mA}$) when current of 1 mA flows.

$$\text{Flatness}=V_{5kA}/V_{1mA}$$

WITHSTANDING INPUT ENERGY: A total input energy (E) per unit volume of ZnO element when current of 2 ms*IA is supplied to the ZnO element repeatedly N times until causing failure.

$$E=(2\times10^{-3}\times I\times V\times N)/\text{Volume of the element (cm}^3)$$

Where, V: A terminal voltage of the element when current of IA flows.

LEAK CURRENT: An effective current (AC) flows through an element when a voltage (wave height AC), which is 90% of $V_{1mA}$ (a terminal voltage when current of 1 mA is applied to a ZnO element at room temperature), is supplied between terminals in the element at 120° C.

Very important characteristics for arresters are their discharge withstanding capacity and their voltage applying life time characteristics. Especially for ZnO elements used in a gap-less arrester, they are always in a voltage applied condition and minute leakage current occurs in the ZnO element, the leakage current gradually increasing as the voltage applied time increases. In some cases, the ZnO element is heated to cause a thermal runaway phenomenon. To prevent the ZnO element from the thermal runaway phenomenon and to thus improve its life time, it is important that the increasing rate of the leakage current decreases as the voltage applied time increases. For a ZnO element having a high limiting voltage, it is also important that the discharge withstanding capacity and the voltage applying life time characteristics are outstanding.

The limiting voltage is generally indicated by the voltage per unit thickness of ZnO element when current of 1mA flows in the ZnO element. Since the limiting voltage of a ZnO element is determined by the number of grain layers in the ZnO element existing between its electrodes, the limiting voltage depends on the grain size of the ZnO forming the sintered body when it is evaluated by unit thickness. Therefore, in order to increase the limiting voltage of a ZnO element, it is effective that the growth of grains composing the sintered body be suppressed. In the past, the method employed to suppress the grain growth has been a method having low sintering temperature or a method adding a grain growth suppressing agent such as $SiO_2$. For example, methods in which a fairly large amount of $SiO_2$ is added compared to a usual fabricating method are described in Japanese Patent Publication No. 55-13124 (1980) and Japanese Patent Publication No. 59-12001 (1984).

On the other hand, a method to obtain a long life element by suppressing the deterioration in characteristics due to voltage normally applying to a ZnO element is described in Japanese Patent Application Laid-Open No. 58-159303 (1983). The method to prevent the deterioration in the characteristics of the ZnO element is a so-called once-heat-treatment after sintering in which a ZnO element is sintered at a high temperature of 1050° to 1300° C., is heated to 500° to 700° C., maintained at that temperature for 1 to 2 hours, then cooled to room temperature with a cooling speed of 100° to 300° C./hour. Another method is described in Japanese Patent Application Laid-Open No. 58-200508 (1983) for preventing the deterioration in the characteristics of the ZnO element involving so-called twice-heat-treatment after sintering in which an element containing ZnO as a main component and at least $Bi_2O_3$ is sintered at a high temperature of 1050° to 1300° C., is heated to 850° to 950° C. and maintained at that temperature for 1 to 2 hours, is then cooled to 300° C. with a cooling speed of 300° C./hour, is then re-heated to 500 to 700° C., maintained at that temperature for 1 to 2 hours, and is then re-cooled to room temperature with a cooling speed of 50° to 150° C./hour.

It is economically effective and advantageous to increase the limiting voltage of a ZnO element since this will facilitate manufacture of an arrester for electric power distribution which can be made small in size. Accordingly, an object of the present invention is to increase the limiting voltage of a ZnO element.

One of the methods to increase the limiting voltage of ZnO elements is to suppress grain growth of ZnO by increasing the content of the additive of $SiO_2$ to form $Zn_2SiO_4$ during sintering. However, since the increasing rate of the limiting voltage for a ZnO element having a high content of $SiO_2$ is small when the ZnO element is sintered through the conventional technology described above, a problem is that there is a limitation to make a substantial increase in the limiting voltage even if a great deal of $SiO_2$ is added. Further, another problem is that adding a large amount of the $SiO_2$ decreases the withstanding discharge capacity of the ZnO element due to local concentration of current flow since changes in the composite oxide due to reaction of $SiO_2$ with other additives occurs to make the insulation characteristic of grain boundary precipitation non-uniform. Furthermore, in the method to suppress the grain growth of ZnO by low temperature sintering, there is a problem in that the withstanding capacity of the sintered body cannot be increased since its sintering is insufficient.

The ZnO element has a structure in which a ZnO particle is surrounded with a high resistive boundary layer and the resistance of the boundary layer has a non-linearity against voltage.

Generally, the voltage-current characteristic of a ZnO element can be expressed by the following equation.

$$I=KV^{60} \quad \text{(Equation 1)}$$

Where I is the current, V is the voltage, K is a constant, $\alpha$ is a non-linear coefficient. The coefficient $\alpha$ for ZnO elements is approximately 10 to 70.

When the coefficient $\alpha$ is large, the leakage current flowing in the ZnO element under normal voltage applying condition is small. Therefore, the coefficient $\alpha$ is preferably large. In order to suppress the increase of leakage current due to applying voltage for a long time, it is effective that a $\gamma$-type $Bi_2O_3$ phase is formed in the ZnO element with heat-treatment of the sintered ZnO element.

However, the above-mentioned conventional technology, where a sintered ZnO element is heat-treated once at a temperature of 500° to 700° C., has a disadvantage in that the voltage-current characteristic of the element is inferior though the deterioration in characteristic can be suppressed by forming y-type $Bi_2O_3$ in the ZnO element.

On the other hand, in the case to improve the life time of the ZnO elements by twice heat-treating a sintered ZnO element, there is a problem in that when the $\gamma$-type $Bi_2O_3$ is not formed in the ZnO element in the first heat-treatment, the voltage applying life time characteristic of the ZnO element does not improve even if the second heat-treatment is performed. For example, in a case where an element composed of ZnO as a main component and $Bi_2O_3$, and which contains many kinds of metallic oxides such as $Sb_2O_3$, $MnCO_3$, $Cr_2O_3$, $Co_2O_3$, $SiO_2$, NiO, $B_2O_3$, $Al(NO_3)_3$ and so on, there is a problem, in some cases, that the $\gamma$-type $Bi_2O_3$ is hardly formed in the ZnO element and the coefficient $\alpha$ becomes small when the sintered ZnO element is cooled in the first heat-treatment at the cooling speed of 300° C./h as described in the conventional technology.

For the above-noted reason, in the conventional technology, a multi- component ZnO element used in a high applying voltage environment is insufficient in reliability in withstanding discharge capacity and in voltage applying lifetime characteristics.

An object of the present invention is to provide a method of fabricating a high limiting voltage and stable ZnO element and an artester therewith where the ZnO element is high in reliability with respect to the withstanding discharge capacity characteristic and the voltage applying life time characteristic, and which does not deteriorate in its characteristics.

In order to attain the above objects, according to the present invention, there is provided a method of fabricating a voltage non-linear resistor which comprises, in a process for mixing a raw material containing ZnO as a main component with additives to produce voltage non-linearity such as $Bi_2O_3$, $Co_2O_3$, MnO, $Sb_2O_3$, $Cr_2O_3$, NiO, $SiO_2$, $GeO_2$, $Al(NO_3)_3$, $B_2O_3$ and so on, through a process for mixing the additives without $SiO_2$ and $GeO_2$ or a process for mixing the additives without at least one of $SiO_2$ and $GeO_2$, calcining the mixture in atmospheric environment at a temperature of 800° to 1000° C., milling the calcined mixture to obtain composite oxide, mixing and granulating the composite oxide with $SiO_2$, 1% to 50% by weight (wt %) against the total weight of the composite oxide to form a compacted body. The method further comprises a process for sintering the compacted body at a temperature of 1150° to 1300° C., a process of a first heat-treatment which is composed of cooling the sintered body below 300° C., after that heating it to 800° to 950° C. and maintaining that temperature for 1 to 3 hours, then cooling it below 300° C., a process of a second heat-treatment which is composed of heating it again to 650° to 900° C. and keeping the temperature for 1 to 3 hours, then cooling it to room temperature, wherein the cooling speeds after keeping the sintered element in the first and second heat-treatment are below 100° C. and 150° C., respectively.

Another aspect of preferred embodiments of the present invention is to provide an apparatus for fabricating granular powder which comprises a mechanism for calcining additives such as $Bi_2O_3$, $Sb_2O_3$, $MnCO_3$, $Cr_2O_3$, $Co_2O_3$, $Sio_2$, NiO, $B_2O_3$ and so on and for weighing a milled composite oxide and $SiO_2$, a mechanism for mixing the weighed composite oxide and $SiO_2$, a mechanism for weighing ZnO and $Al(NO_3)_3$, and a mechanism for mixing mixed powder of said composite oxide and said $SiO_2$ and mixed powder of ZnO and $Al(NO_3)_3$ to fabricate a granular powder.

Another aspect of preferred embodiments of the present invention is to provide an arrester constructed by placing the ZnO element, formed as a disk-shaped or cylinder-shaped sintered body and having an electrode at its end surface except its peripheral surface manufactured through the above-mentioned method, into an insulator tube or insulator tank.

Other objects, advantages and novel features of the present invention will become apparent from the following detailed description of the invention when considered in conjunction with the accompanying drawings.

DETAILED DESCRIPTION OF THE DRAWINGS

The ZnO element according to the present invention is obtained by mixing a main component of ZnO with metallic oxides such as $Bi_2O_3$, $Sb_2O_3$, $MnCO_3$, $Co_2O_3$, NiO, $B_2O$, $Al(NO_3)_3$ and so on or with metallic oxides, adding $SiO_2$ to the above metallic oxides as additives to produce voltage non-linearity with given proportions, and calcining the mixture at temperature of 800° to 1000° C. to obtain a composite oxide.

Figure 1:
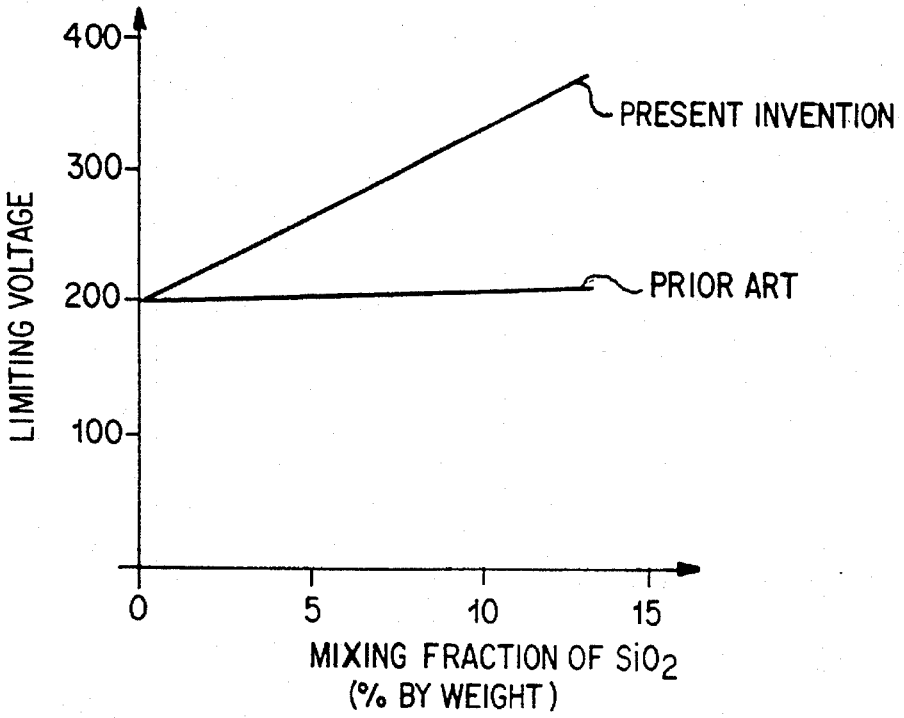
FIG. 1 is an explanatory graph showing the limiting voltage as a function of the mixing fraction of $SiO_2$ of an element in accordance with the present invention, as compared to the prior art.
Figure 1A:
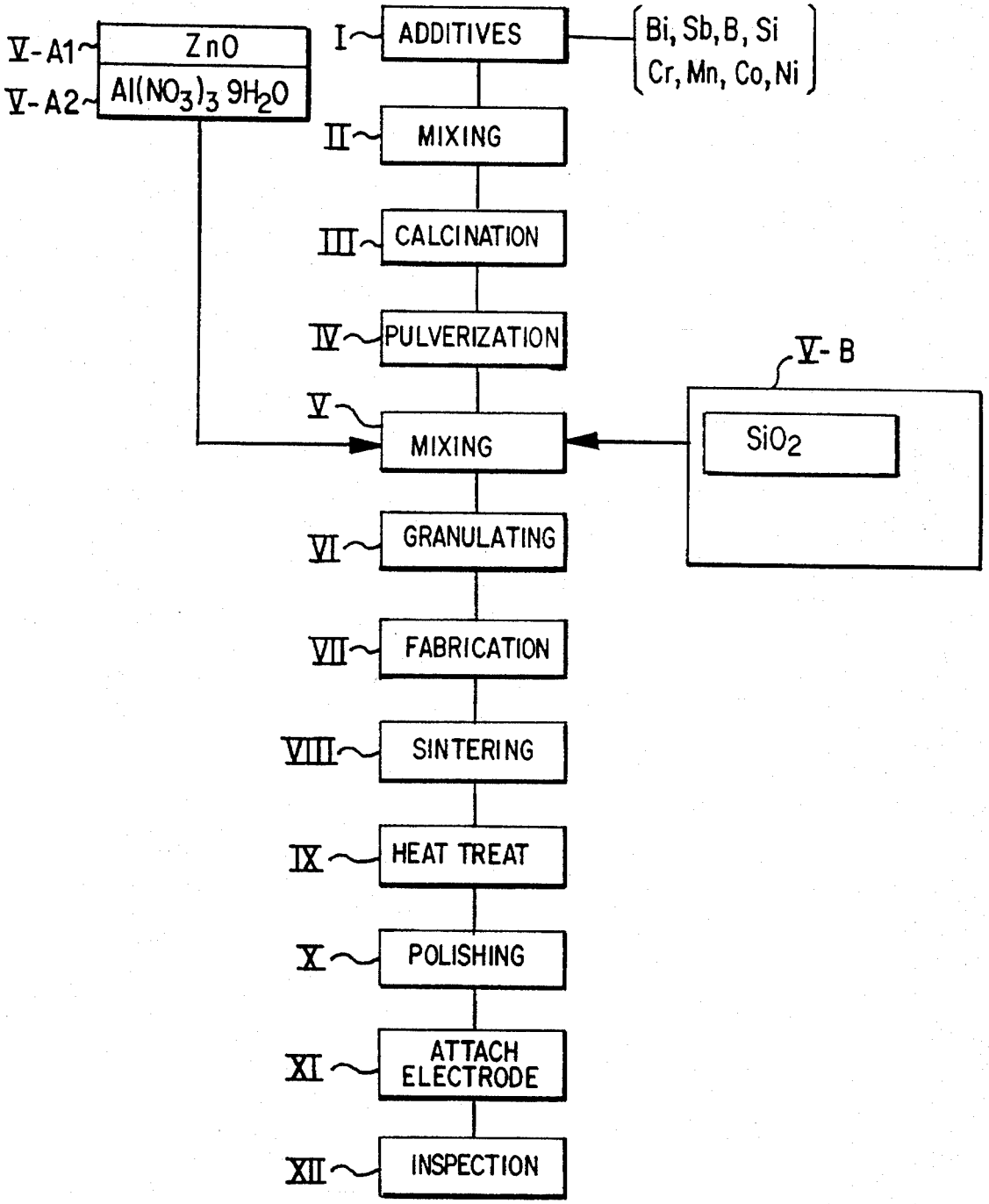
FIG. 1A is a flow chart depicting the ZnO element fabricating process of the present invention.

FIG. 1A is a flow chart depicting the ZnO element fabrication process according to the present invention. Metallic oxides, optionally including $SiO_2$, are provided in Step I, mixed in Step II, calcined in Step III, pulverized in Step IV and mixed together with other components in Step V. Steps V-A-1 and V-A-2 indicate provision of ZnO and $Al(NO_3)_3 9H_2O$ for the mixing Step V. Step V-B indicates the provision of $SiO_2$ alone for the mixing Step V, this Step V-B being a novel departure of the present invention from prior ZnO element fabrication processes. The mixture resultant from Step V is granulated at Step VI, fabricated to form a ZnO element at Step VII, sintered at Step VIII, heat treated at Step IX, polished at Step X, attached to electrode at Step XI and inspected at Step XII. In a preferred embodiment of the invention, the heat treatment of Step IX involves a double heat treatment. Other than (i) the mixing step V including the addition of $SiO_2$ alone (Step V-B); (ii) the double heat treatment Step IX; and (iii) the preferred composition mixtures and temperatures described herein; and (iv) the preferred mixing steps and mechanism described herein, the general process outlined in FIG. 1A is similar to prior art ZnO fabrication processes.

The effect of mixing and calcining said metallic oxides is to prevent the ZnO element from producing voids in a process for sintering a compacted body since gases such as $CO_2$, $O_2$, $NO_2$, $H_2O$ and so on are sufficiently discharged by burning reaction and oxidation reaction during calcining of the metallic oxides. Further, the withstanding discharge capacity of the ZnO element is increased since there is no possibility to segregate a specific additive in the sintered body.

Next, said composite oxide is mixed with $SiO_2$ and ZnO with given proportions, granulated, compacted in a given shape, and then sintered at a temperature of 1050° to 1300° C. for 1° to 12° hours.

For the ZnO elements which are fabricated through processes for adding to the composite oxide $SiO_2$ of 1 to 50 wt % against the total weight of said composite oxide, mixing ZnO with the composite oxide, granulating and compacting the mixture to form a ZnO element, the limiting voltage ($V_{1mA}$) of the ZnO element is 210 to 300 V/mm.

The reason why the limiting voltage of the ZnO element is increased is as follows:

(1) In the process for mixing the ZnO with the composite oxide and $SiO_2$, the $SiO_2$ is uniformly dispersed, and in the process for sintering after the processes for granulating and compacting, the $SiO_2$ easily reacts with ZnO and $Zn_2SiO_4$ is uniformly formed over the grain boundaries to suppress the grain growth of ZnO. The present invention also contemplates mixing $GeO_2$ instead of $SiO_2$, in which case the $GeO_2$ would react with ZnO and $Zn_2GeO_4$ would then be uniformly formed over the grain boundaries to suppress the grain growth of ZnO. Since actual tests with $GeO_2$ have not yet been conducted, further discussion of such embodiments is not included herein.

(2) Utilizing the inventive process, the number of ZnO particles per unit thickness of the ZnO element is increased.

In the inventive process, when the mixed amount of the $SiO_2$ is decreased to less than 1 wt % against the total weight of the composite oxide, the effect of suppressing the grain growth of ZnO is degraded and the limiting voltage of the ZnO element cannot be increased sufficiently since the yield of $Zn_2SiO_4$ is small.

On the other hand, when the mixed amount of the $SiO_2$ is increased larger than 50 wt % against the total weight of the composite oxide, the effective resistance of the ZnO element itself is increased and the withstanding discharge capacity characteristic is degraded since the yield of $Zn2SiO_4$ is excessively large.

Since the grain growth of ZnO is decelerated as the sintering temperature of the compacted body is decreased, the limiting voltage of the element can be increased corresponding to the mixed amount of $SiO_2$. However, as shown in FIG. 3 and FIG. 4, when the sintering temperature is higher than 1150° C., the sintering density of the ZnO element becomes excessively low and the withstanding discharge capacity is decreased.

Figure 3:
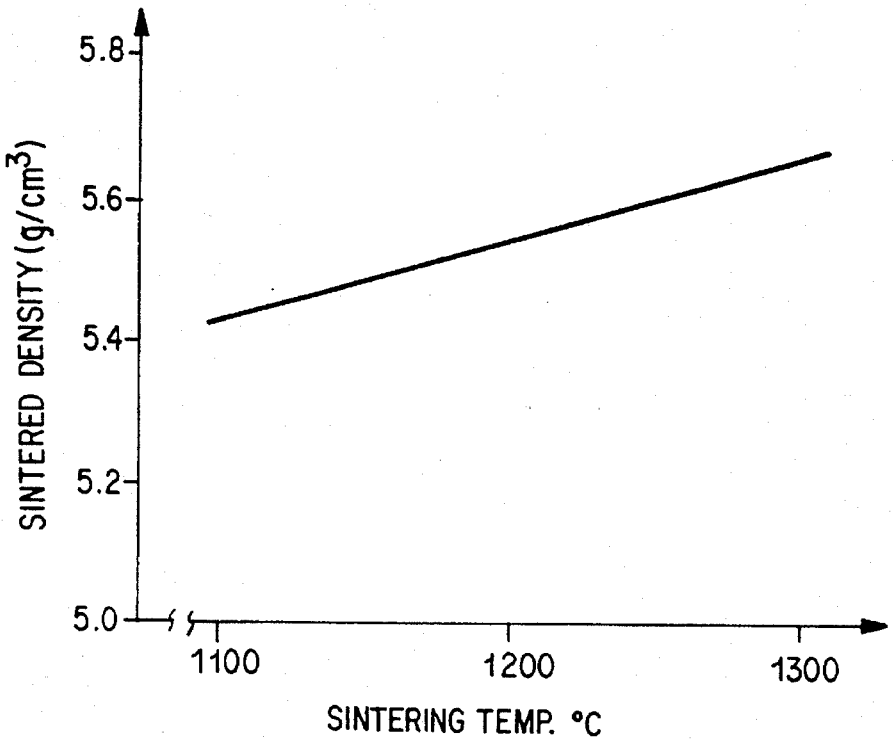
FIG. 3 is an explanatory graph showing the sintering density of an element in accordance with the present invention when the sintering temperature is varied.
Figure 4:
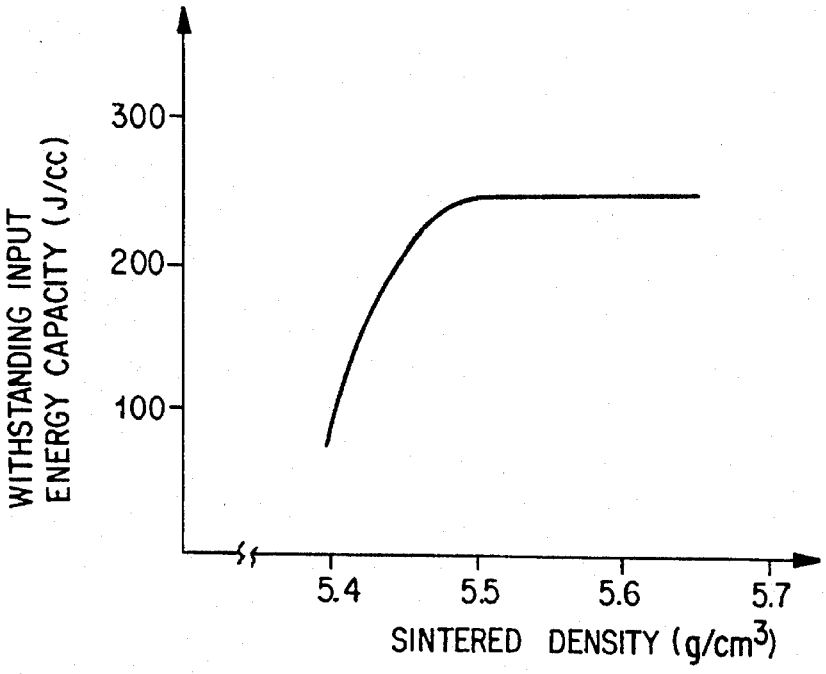
FIG. 4 is an explanatory graph showing the withstanding input energy of an element in accordance with the present invention when the sintering density is varied.

FIG. 3 shows the relationship between sintering temperature and sintering density of the element according to the present invention. FIG. 4 shows the relationship between sintering density and input energy of the element according to the present invention.

Since the grain growth of ZnO is accelerated as the sintering temperature of the compacted body is increased, the limiting voltage of the element can be increased by increasing the mixed amount of $SiO_2$ to suppress the grain growth of ZnO. However, when the compacted body is sintered at a temperature above 1300° C., thermal deformation and cracks occurs in the ZnO element and no satisfactory element can be obtained. As shown in the results described herein, it is preferable that the sintering temperature of the compacted body of the ZnO element be in the range of 1150° to 1300° C., that is, the sintering density is in the range of 5.50 to 5.65 g/cm$^3$, and the mixed amount of $SiO_2$ or is 1 to 50 wt % against the total weight of composite oxide.

Figure 2:
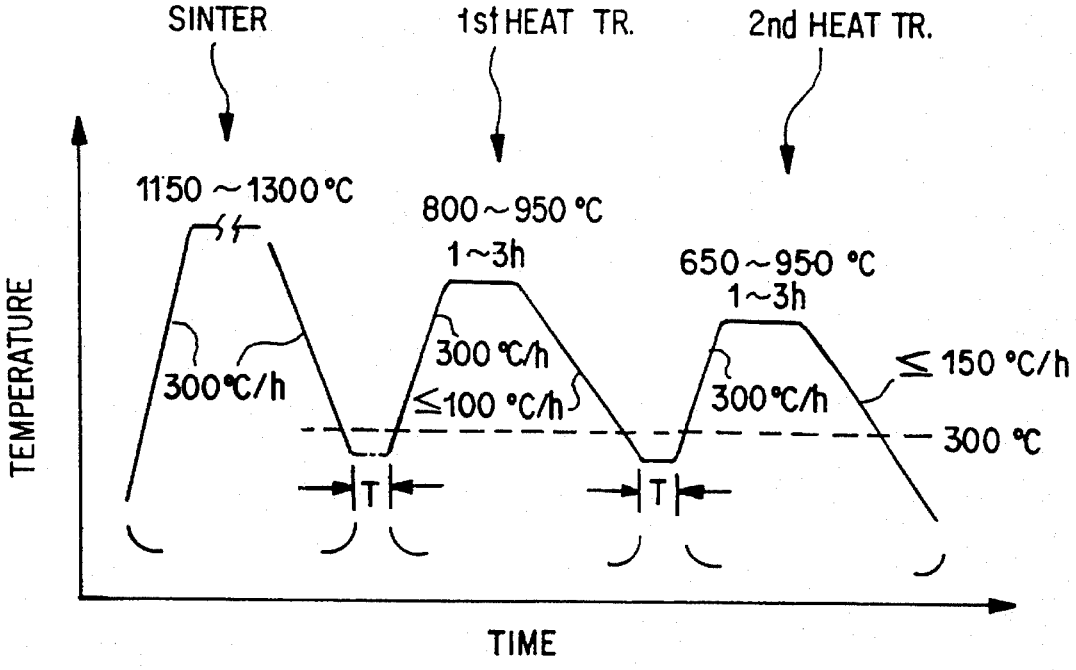
FIG. 2 is an explanatory graph showing the sintering and the heat-treating patterns in accordance with the present invention.

The voltage applying life time characteristic can be stabilized by performing at least twice heat-treatments of the sintered ZnO element. The present invention employs the sintering and the heat-treatment patterns shown in FIG. 2. A compacted body composed of ZnO as a main component, which is fabricated by mixing ZnO with said composite oxide and $SiO_2$, and by granulating and compacting the mixture, is firstly sintered at a temperature of 1150° to 1300° C. for 1 to 12 hours. The heating and cooling speeds of temperature in this process are below 300° C./hour to protect the ZnO element against thermal destruction. At completion of sintering, the temperature is decreased to 300° C. to stabilize the crystal and grain boundary structure of the element. With holding time T, or immediately after cooling the temperature to 300° C., the heat-treatment is initiated.

In the first heat-treating process, the sintered ZnO element is heat-treated at a temperature of 800° to 950° C. (preferably 850°–950°) for 1 to 3 hours to form γ-type $Bi_2O_3$, in the ZnO element. Forming Y-type $Bi_2O_3$ in the ZnO element improves the life time characteristic of the element. Although the reason is not exactly clear, the following explanation is believed to apply.

(1) When a ZnO element is heat treated in a nitrogen environment, a deterioration of characteristics similar to that due to long time voltage applying takes place. And when the element deteriorated in the characteristics is heat-treated in the air, the characteristic recovers. From these facts, it is considered that the deterioration in the characteristic of ZnO element due to long time voltage applying is caused by discharging oxygen ions existing in boundary layers and on surfaces of crystal particles to the surrounding space due to heating of the element during voltage applying to decrease electrostatic potential (decrease varistor voltage) of the boundary layers.

(2) Generally, γ-type $Bi_2O_3$ is high in crystallizing capability, small in internal defects and large in volume compared to α-type $Bi_2O_3$, γ-type $Bi_2O_3$ and δ-type $Bi_2O_3$. Therefore, there is an effect to prevent the oxygen from diffusing along the boundary layers of the ZnO crystals. From this fact, the oxygen ions existing on the surfaces of the ZnO particles are prevented from moving and the ZnO element is stabilized against voltage applying.

The temperature cooling speed of the ZnO element in the first heat-treating process is below 100° C./h to produce γ-type $Bi_2O_3$ in the ZnO element. When the temperature cooling speed exceeds 100° C., γ-type $Bi_2O_3$ is not produced. Further, there is an effect in that the amount of voids in sintered ZnO element is decreased by dissolving $Bi_2O_3$ in the first heat-treatment to prevent the varistor voltage from decrease and to prevent the characteristics of the ZnO element from deterioration. When the temperature is below 800° C., the $Bi_2O_3$ layer in the grain boundary of the ZnO element is not dissolved sufficiently. And when the temperature is above 950° C., the dissolution of the $Bi_2O_3$ layer is not limited in the grain boundary region since the thermal activity of the ZnO crystal becomes too high and the oxygen ions adhered to the ZnO grain boundary are apt to be discharged.

A heat-treating time shorter than 1 hour is not enough to display the effect; keeping the temperature, and the time longer than 3 hours causes a problem of activation of the ZnO crystal.

Next, as the second heat-treatment, with arbitrary holding time T, or immediately after the temperature drops below 300° C. in the first heat-treatment, the element is heated to 650 to 950° C. (preferably 850° to 950° C.) and is maintained at that temperature for 1 to 3 hours, and then cooled.

With the second heat-treatment, the remaining $Bi_2O_3$ which has not been changed into γ-type $Bi_2O_3$ in the first heat-treatment is changed to γ-type $Bi_2O_3$. In this second heat-treatment, the element is heated up to a temperature of 650° to 950° C. with arbitrary holding time T, or immediately after the temperature drops below 300° C. in the first heat-treatment, and is maintained for 1 to 3 hours, and then cooled. The holding time of 1 to 3 hours is determined for the same reason described above.

The temperature cooling speed in the second heat-treatment is below 150° C./hour. This temperature cooling speed has an effect to improve the characteristic of the element by removing thermal deformation of the ZnO element.

Embodiments are contemplated wherein the same heat-treatment as the second heat-treatment is repeated.

Following are examples of the present invention.

(Example 1)

In the following description, parenthetical () references are made to corresponding method steps of FIG. 1A.

A starting raw material is prepared by weighing each of required amounts of powders so as to be composed of 95.17 mole % of ZnO having purity more than 99.9% (FIG. 1A-Step V-A1); 0.01 mole % of $Al(NO_3)_3$ (FIG. 1A-Step V-A2); and 0.7 mole % of $Bi_2O_3$, 1.0 mole % of $Sb_2O_3$, 0.5 mole % of $MnCO_3$, 1.0 mole % of $Co_2O_3$, 0.5 mole % of $Cr_2O_3$, 1.0 mole % of NiO, and 0.12 mole % of $B_2O_3$ (FIG. 1A-Step I). The following table sets forth the weight percentages of these components:

TABLE 1

| | |
|---|---|
| ZnO = 95.17 Mol. % | 88.55% by weight |
| $Bi_2O_3$ = 0.7 Mol. % | 3.73% by weight |
| $Sb_2O_3$ = 1.0 Mol. % | 3.33% by weight |
| $MnCO_3$ = 0.5 Mol. % | 0.66% by weight |
| $Co_2O_3$ = 1.0 Mol. % | 1.90% by weight |
| $Cr_2O_3$ = 0.5 Mol. % | 0.87% by weight |
| NiO = 1.0 Mol. % | 0.85% by weight |
| $B_2O_3$ = 0.12 Mol. % | 0.095% by weight |
| $Al(NO_3)_3$ = 0.01 Mol. % | 0.024% by weight |

The metal oxide additives are mixed using a wet water Purl milling machine (FIG. 1A-Step II) and the obtained mixture is dried by a spray dryer in the air at temperature of 850° C. (FIG. 1A-Step III) and granulated or pulverized (FIG. 1A-Step III) obtaining particles having a diameter in a range of 10–20 μm. In this operation, when the calcining temperature is below 800° C., a lot of voids are formed in the later resultant ZnO element sintered body due to insufficient reaction among the additive components. On the other hand, when the calcining temperature is above 1000° C., the metallic oxide additives are deoxidized and the effect of additives to produce voltage non-linearity is not obtained. Next, after weighing the composite oxide equivalent to the total weight which is obtained by weighing each of the above-mentioned metallic oxide additives and weighing $SiO_2$ ((FIG. 1A-Step V-B) corresponding to 1, 5, 10, 30 and 60 wt % of the weight of the composite oxide, the composite oxide, the $SiO_2$ and ZnO are mixed using a ball milling machine (FIG. 1A-Step V) to prepare five kinds of granular powders having different amounts of $SiO_2$.

An average grain size of the raw material is in a range of 0.5–1 μm.

When the additive amount of $SiO_2$ is zero, the obtained sintered body has an average grain size of about 15 μm an the number of grains having the maximum intersecting length of at least 20 μm is 26 per 0.01 $mm_2$ region, when the additive amount of $SiO_2$ is 10% by weight (about 1.8 Mol. % in total weight), the average grain size is about 10 μm and the number of grains having the maximum intersecting length of at least 20 μm is at most 5 per 0.01 $mm_2$ region, and when the additive amount of $SiO_2$ is 30% by weight (about 5.5 Mol. % in total weight), the average grain size is about 7 μm and the number of grains having the maximum intersecting length of at least 20 μm is zero per 0.01 $mm_2$ region.

After press compacting the granulated powders (FIG. 1A-Step VII), the thus formed compacted bodies are sintered (FIG. 1A-Step VIII) at a temperature of 1190° C. for approximately 4 hours. On this occasion, the heating and cooling speeds of temperature are approximately 70° C./h, and the sintered bodies are cooled to room temperature. The dimension of the ZnO elements after sintering is ϕ33×30t. Then the sintered bodies are heated to 850° C., held for 2 hours at that temperature, cooled to room temperature at a temperature cooling speed of approximately 70° C./h (the first heat-treatment of FIG. 1*a*-Step IX), heat-treated again under the same heat-treatment condition as that of the first heat-treatment (the second heat-treatment of FIG. 1A-Step IX). ZnO elements are formed by polishing the same (FIG. 1A-Step X) and attaching electrodes to the sintered bodies obtained through the heat-treatments (FIG. 1A-Step XI). The ZnO elements are then inspected to confirm quality (FIG. 1A-Step XII). The limiting voltage ($V_{1mA}$) and the withstanding discharge capacity characteristic of the fabricated ZnO element are shown in FIG. 1 and FIG. 5, respectively.

The withstanding discharge capacity characteristic is evaluated by the maximum input energy to destroy an element when a rectangular-wave current having a width of 2 ms is conducted to the ZnO element.

As shown in FIG. 1, the limiting voltage ($V_{1mA}$) of the ZnO element increases approximately in proportion to the amount of $SiO_2$ mixed in the composite oxide, the limiting voltage for $SiO_2$ mixed amount of 50 wt % is approximately 1.4 times as large as that of the conventional element containing the same amount of $SiO_2$ (in a case of containing $SiO_2$ in the composite metal oxides, but with no addition of $SiO_2$ as per FIG. 1A-Step IV-B).

Figure 5:
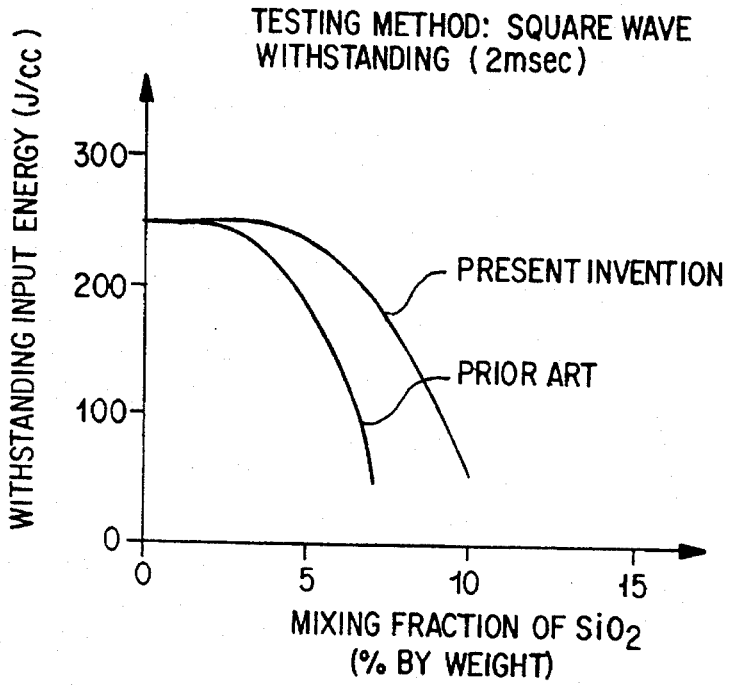
FIG. 5 is an explanatory graph showing the withstanding input energies of an element in accordance with the present invention and a conventional element.

On the other hand, the withstanding discharge capacity of the ZnO element in accordance with the present invention is, as shown in FIG. 5, nearly constant and above approximately 250 J/cc in the range of mixed amount of $SiO_2$ below 30 wt %. However, since the withstanding discharge capacity decreases when the mixed amount of $SiO_2$ exceeds 50 wt %, it is preferable that the amount of $SiO_2$ mixed to the composite oxide is below 50 wt % when the withstanding discharge capacity above 200 J/cc is required.

Although the limiting voltage of the conventional element is, as shown in FIG. 1, lower than that of the element according to the present invention in the range of mixed amount of $SiO_2$ (amount of $SiO_2$ mixed in the composite oxide) lower than 20 wt %, the withstanding discharge capacity of the conventional element is nearly equal to that of the element according to the present invention but substantially decreases when the mixed amount of $SiO_2$ exceeds 20 wt %.

(Example 2)

A starting raw material is prepared by weighing each of the required amounts of powders so as to be composed of 93.67 mole % of ZnO having purity more than 99.9% (FIG. 1A-Step V-A1); 0.01 mole % of Al $(NO_3)_3$ (FIG. 1A-Step V-A2); and 0.7 mole % of $Bi_2O_3$, 1.0 mole % of $Sb_2O_3$, 0.5 mole % of $MnCO_3$, 1.0 mole % of $Co_2O_3$, 0.5 mole % of $Cr_2O_3$, 1.5 mole % of $SiO_2$, 1.0 mole % of NiO, and 0.12 mole % of $B_2O_3$ (FIG. 1A-Step I). The following Table 2 sets forth the weight percentages of the components of these powders.

TABLE 2

| | |
|---|---|
| ZnO = 93.67 Mol. % | 87.48% by weight |
| $Bi_2O_3$ = 0.7 Mol. % | 3.74% by weight |
| $Sb_2O_3$ = 1.0 Mol. % | 3.34% by weight |
| $MnCO_3$ = 1.0 Mol. % | 0.66% by weight |
| $Co_2O_3$ = 1.0 Mol. % | 1.90% by weight |
| $Cr_2O_3$ = 0.5 Mol. % | 0.87% by weight |
| NiO = 1.0 Mol. % | 0.86% by weight |
| $SiO_2$ = 1.5 Mol. % | 1.03% by weight |
| $B_2O_3$ = 0.12 Mol. % | 0.096% by weight |
| $Al(NO_3)_3$ = 0.01 Mol. % | 0.024% by weight |

The metallic oxide material is mixed and then calcined in the air at 850° C. (FIG. 1A-Step III) then the calcined oxides are milled (FIG. 1A-Step IV) to produce a composite metallic oxide mixture containing $SiO_2$.

Next, after weighing the composite oxide equivalent to the total weight which is obtained by weighing each of the above-mentioned metallic oxide additives and weighing $SiO_2$ (FIG. 1A-Step V-B) corresponding to 1, 5, 10, 30 and 60 wt % of the weight of the composite oxide, the composite oxide, the $SiO_2$ and ZnO are mixed using a ball milling machine (FIG. 1A-Step V) to prepare five kinds of granular powders having different amounts of $SiO_2$.

Press compaction, sintering and heat-treating of the granular powder are carried out under the same condition as in Example 1 to form ZnO elements (dimension: ϕ33×30t).

Figure 6:
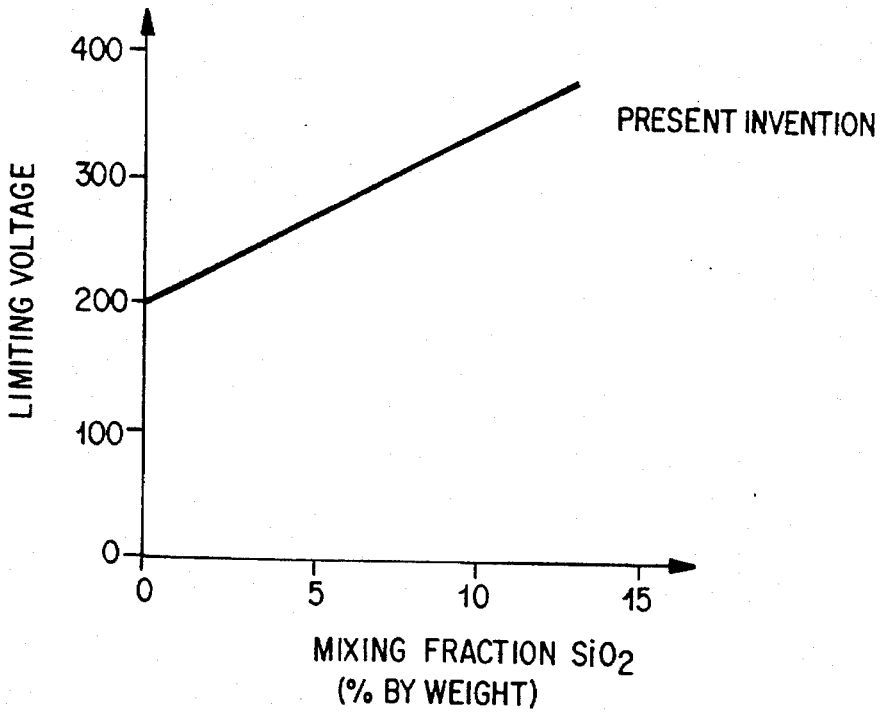
FIG. 6 is an explanatory graph showing the limiting voltage of an element in accordance with the present invention.
Figure 7:
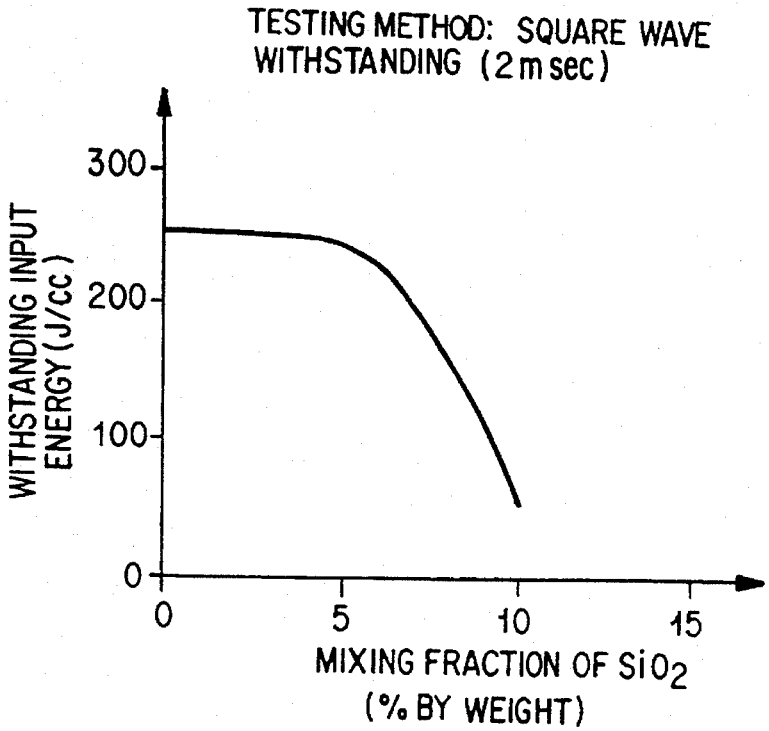
FIG. 7 is an explanatory graph showing the withstanding input energy of an element in accordance with the present invention.

The limiting voltage ($V_{1mA}$) and the withstanding discharge capacity characteristic of the ZnO element fabricated through further mixing a composite oxide containing $SiO_2$ with $SiO_2$ of 1 to 60 wt % of the weight of the composite oxide are shown in FIG. 6 and FIG. 7, respectively.

The limiting voltage of the ZnO element increases as the mixed amount of $SiO_2$ increases, the limiting voltage for $SiO_2$ with mixed amount of 50 wt % becomes approximately 300 V/mm.

The limiting voltage is nearly equal to that (290 V/mm) of the ZnO element having $SiO_2$ with mixed amount of 50 wt % fabricated in Example 1.

It can be understood by comparing FIG. 1 with FIG. 6 that the limiting voltage of the ZnO element does not vary largely and is regardless of presence or absence of $SiO_2$ contained in the composite metallic oxide.

On the other hand, although the withstanding discharge capacity of the ZnO element, as shown in FIG. 7, slightly decreases as the mixed amount of $SiO_2$ increases, the withstanding discharge capacity is larger than approximately 250 J/cc in the range of mixed amount of $SiO_2$ between 1 to 30 wt % and does not vary largely depending on the amount of $SiO_2$. However, the withstanding discharge capacity decreases when the mixed amount of $SiO_2$ exceeds 30 wt %. There is no significant difference in withstanding discharge capacity characteristic between the ZnO elements fabricated in Example 1 and in Example 2.

Figure 8:
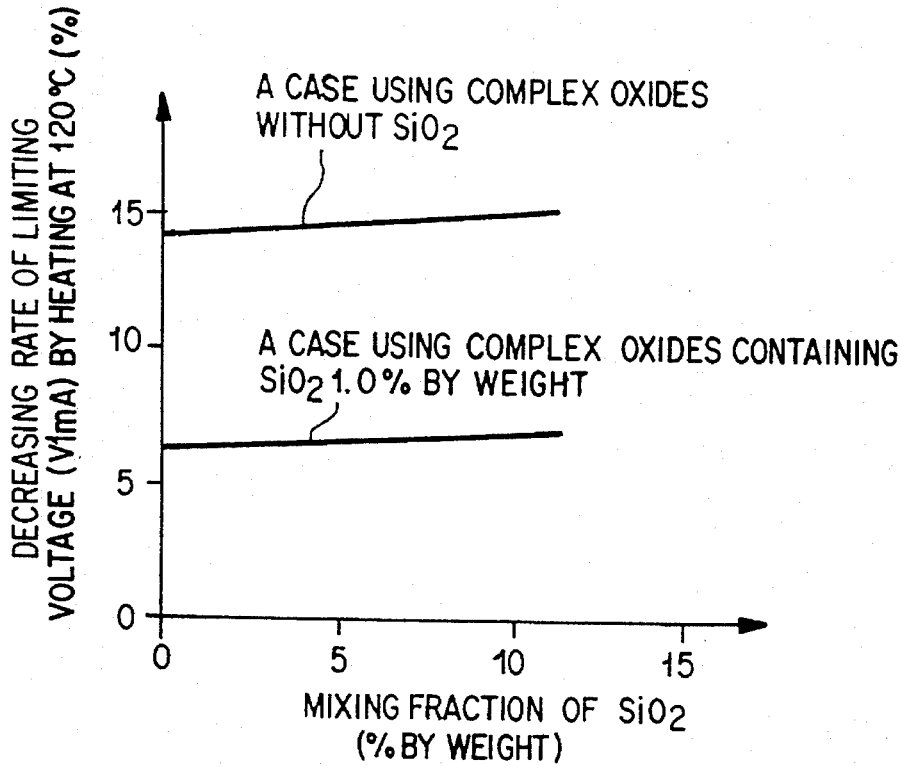
FIG. 8 is an explanatory graph showing the decreasing rate of AC limiting voltage by heating an element in accordance with the present invention.

FIG. 8 shows the decreasing rates of limiting voltage ($V_{1mA}$) of the ZnO elements fabricated in Example 1 and in Example 2 under heating condition at 120° C. in the air ((limiting voltage at room temperature—limiting voltage at 120° C.)/(limiting voltage at room temperature)×100(%)).

The decreasing rates of limiting voltage of the ZnO elements fabricated in Example 1 and in Example 2 are approximately 14 to 15% and approximately 6 to 7% in the range of $SiO_2$ mixed amount between 1 to 50 wt %, respectively, and there is no large difference in changing rates of the decreasing rates of limiting voltage depending on the amount of $SiO_2$ between them. However, the decreasing rate of limiting voltage under 120° C. heating for the ZnO elements fabricated in Example 2 is approximately one-half as small as that for the ZnO elements fabricated in Example 1. It can be understood from these results that the temperature-dependent characteristic of the ZnO element is substantially improved by re-mixing a composite oxide containing $SiO_2$ with $SiO_2$.

Figure 9:
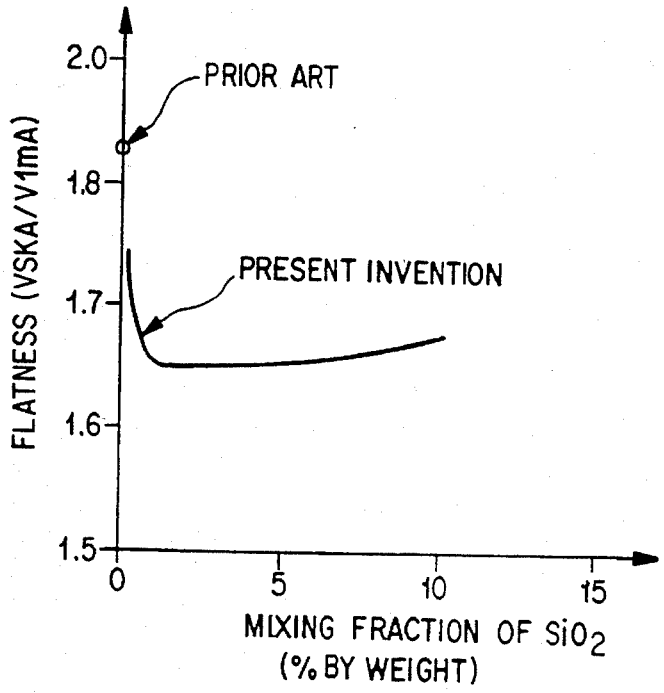
FIG. 9 is an explanatory graph showing the voltage flatness characteristics of an element in accordance with the present invention and a conventional element.

FIG. 9 shows the relationship between mixed amount of $SiO_2$ and flatness ($V_{5kA}/V_{1mA}$) for the element according to the present invention and a conventional element. $V_{5kA}$ and $V_{1mA}$ indicate terminal voltage of an element when currents of $5_{kA}$ and $1_{mA}$ flow in the element, respectively. As shown in FIG. 9, the flatness ($V_{5kA}/V_{1mA}$) for the element according to the present invention is less than 1.7, preferably 1.65 to 1.67, in the range of mixed amount of $SiO_2$ between 10 to 60 wt % and is substantially improved compared to 1.78 in the conventional element.

(Example 3)

The relationship between the heat-treating condition and the voltage applying life time characteristic has been studied by using the ZnO element (just-as sintered) fabricated by mixing $SiO_2$ of 10 wt % to the composite oxide among the five kinds of ZnO elements fabricated in Example 1 and Example 2.

Figure 10:
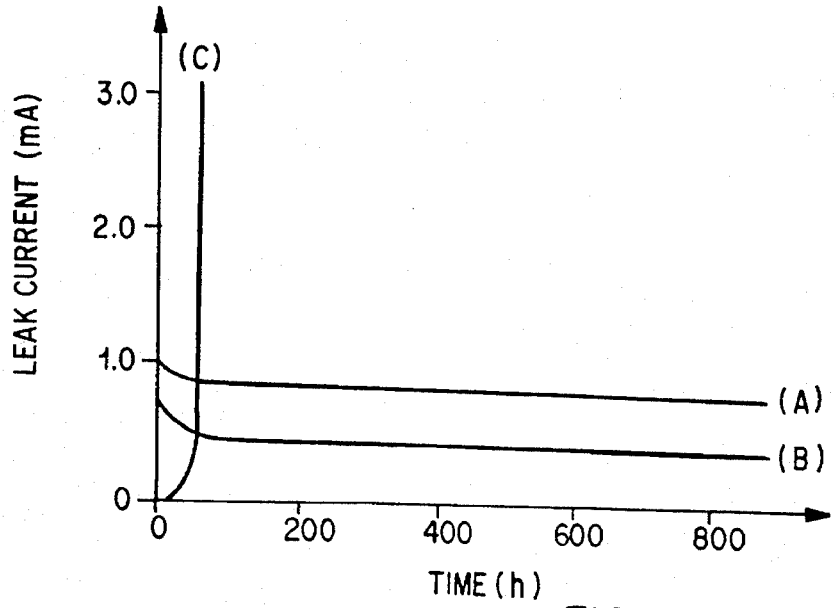
FIG. 10 is an explanatory graph showing the life time characteristic of an element in accordance with the present invention and a conventional element.

Measurement of leak currents was conducted under conditions where the elements are heated at 120° C. and alternating voltage (root-mean square value) is applied to them for a long time with voltage applying rate of 90% (limiting voltage ($V_{1mA}$)×O.9×1/√2) by using ZnO elements heat-treated with the same heat-treating conditions described in Example 1 and Example 2 (element according to Example 1: (A), element according to Example 2: (B)) and an element (C) heat-treated with the conventional method where cooling speed in the first heat-treating process is 300° C./h, far faster than 100° C./h. The result is shown in FIG. 10.

Leak current in the element (C) increases at approximately 50 hours to cause a thermal runaway. Although leak current in the element (A) is approximately 1.3 times as large as current in the element (B), the leak currents in both elements (A) and (B) do not increase and it can be realized to lengthen their life time. Incidentally, presence or absence of γγ-type $Bi_2O_3$ production has been observed on the elements after the first heat-treatment with X-ray diffraction method. It has observed and confirmed that γ-type $Bi_2O_3$ is not produced in the element (C) heat-treated with the conventional method, γ-type $Bi_2O_3$ is certainly produced in the both elements (A,B) heat-treated with the method according to the present invention.

(Example 4)

Figure 11:
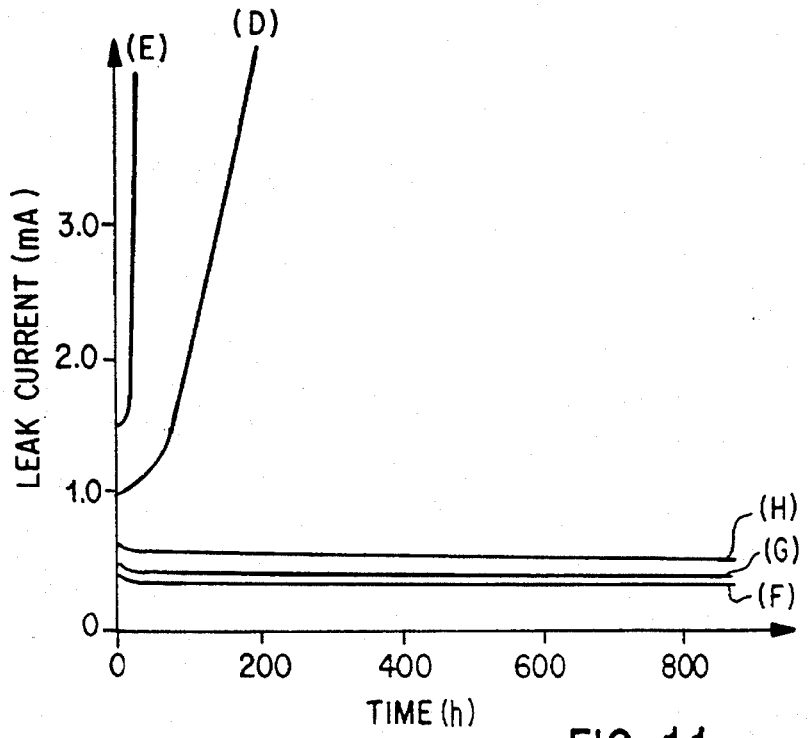
FIG. 11 is a graph showing the life time characteristic of an element when heating temperature in the first heat-treatment is varied.

ZnO elements are prepared by using the ZnO elements as sintered, fabricated by mixing $SiO_2$ of 10 wt % to the composite oxide among the ZnO elements fabricated in Example 2, performing heat-treatments twice with varying heating temperatures in the first heat-treating process of the first and second heat-treating processes described in Example 1 as 750°, 800°, 900°, 950°, and 1000° C. and cooling the ZnO elements at temperature cooling speed of 70° C./hour, and attaching electrodes to the ZnO elements. Measurement of leak current was conducted by applying alternating voltage to the elements under the same condition as in Example 3. FIG. 11 shows the result of leak currents flowing through the ZnO elements varying with time.

Thermal runaway is caused in a short time in the elements heat-treated at temperatures of 750° and 1000° C. in the first heat-treating process, as shown by (D) and (E) in FIG. 11. The reason is considered that for the element heated at 750° C., the $Bi_2O_3$ contained in the ZnO element has not been dissolved, and for the element heated at 1000° C., the γ-type $Bi_2O_3$ has not been produced in the ZnO element.

For the cases of heat-treating temperatures of 800°, 900° and 950° C., as shown by (F), (G) and (H) in FIG. 11, each has little increase in the leak current by voltage applying for long time and it is attained to lengthen its life time, although the element heat-treated at 950° C. has larger leak current than the elements heat-treated at 800° and 900° C. Therefore, the heating temperature in the first heat-treating process is preferably between 800° and 950° C.

(Example 5)

Figure 12:
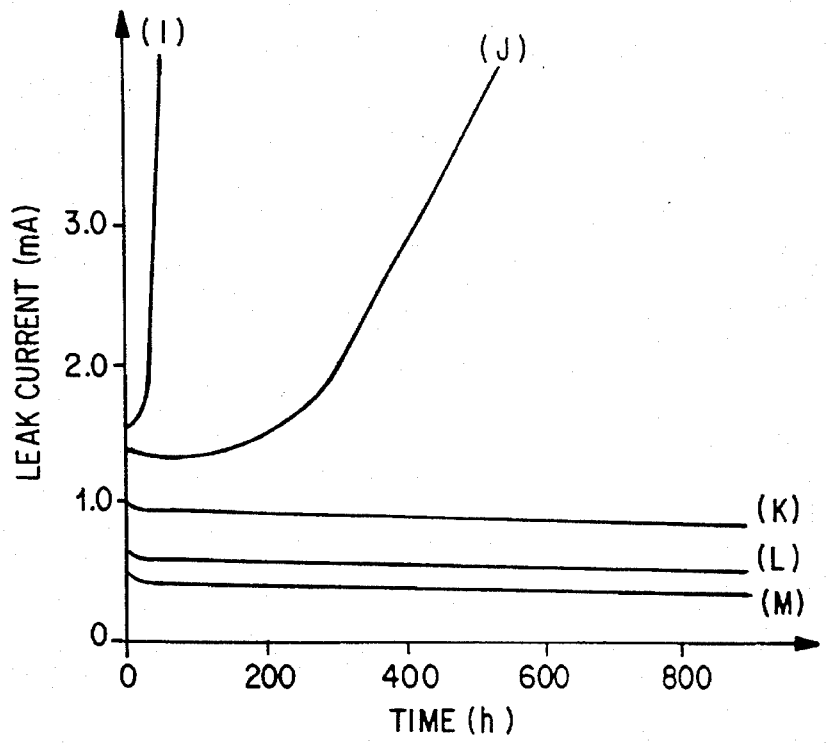
FIG. 12 is a graph showing the life time characteristic of an element when heating temperature in the second heat treatment is varied.

ZnO elements were prepared by using the ZnO elements as sintered, fabricated by mixing $SiO_2$ of 10 wt % to the composite oxide among the ZnO elements fabricated in Example 2, performing heat-treatments twice with varying heating temperatures in the second heat-treating process of the first and second heat-treating processes described in Example 1 as 600°, 650°, 750°, 900° and 950° C., and attaching electrodes to the ZnO elements. Measurement of leak current was conducted by applying alternating voltage to the elements under the same condition as in Example 3. FIG. 12 shows the result of leak currents varying with time flowing through the ZnO elements.

Thermal runaway is caused in a short time in the elements heat-treated at temperatures of 600° and 950° C. in the second heat-treating process, as shown by (I) and (J) in FIG. 12. On the other hand, for the cases of heat-treating temperatures of 650°, 750° and 900° C., as shown by (K), (L) and (M) in FIG. 12, each has little increase in the leak current by voltage applying for long time and can withstand long .time voltage applying, although there are differences in leak current among the elements. Therefore, the heating temperature in the second heat-treating process is preferably 650° to 900° C. Incidentally, in Example 1 through Example 5, when $GeO_2$ is used instead of $SiO_2$ in either of or both of $SiO_2$ in the composite oxide and $SiO_2$ added thereafter, the same effect can be attained.

Based on Examples 1–5 discussed above, the following Table 3 reflects a preferable range of components for an arrester according to the present invention:

TABLE 3

| | | |
|---|---|---|
| $Bi_2O_3$ = 0.4 | – | 1.0 Mol. % |
| $Co_2O_3$ = 0.5 | – | 1.5 Mol. % |
| MnO = 0.2 | – | 0.8 Mol. % |
| $Sb_2O_3$ = 0.5 | – | 1.5 Mol. % |
| $Cr_2O_3$ = 0.2 | – | 0.8 Mol. % |
| NiO = 0.5 | – | 1.5 Mol. % |

TABLE 3-continued

| | | |
|---|---|---|
| $SiO_2$ = 1.0 | – | 3.0 Mol. % |
| $B_2O_3$ = 0.05 | – | 0.2 Mol. % |
| $Al(NO_3)_3$ = 0.002 | – | 0.02 Mol. % |
| ZnO = Residual (desirably 89–96 Mol %), (preferably 90–94.5 Mol. %). | | |

Figure 13:
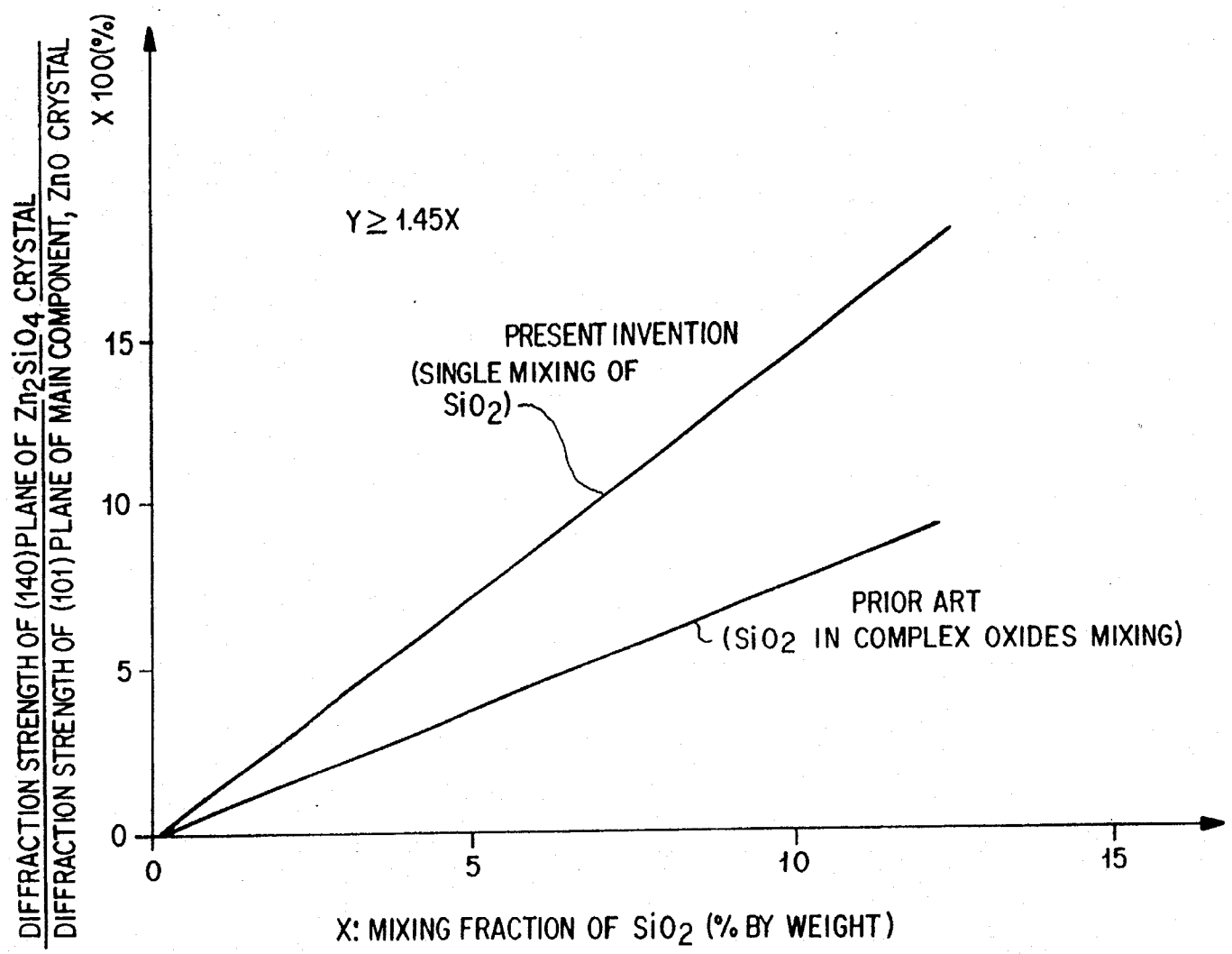
FIG. 13 is a graph showing diffraction strength characteristics of a ZnO element fabricated according to the present invention and according to the prior art.

FIG. 13 is a graph showing the relationship between the mixing fraction of $SiO_2$ and the diffraction strength ratio of the $Zn_2SiO4$ and the ZnO crystals of resistors made according to the prior art and to the invention.

Figure 14:
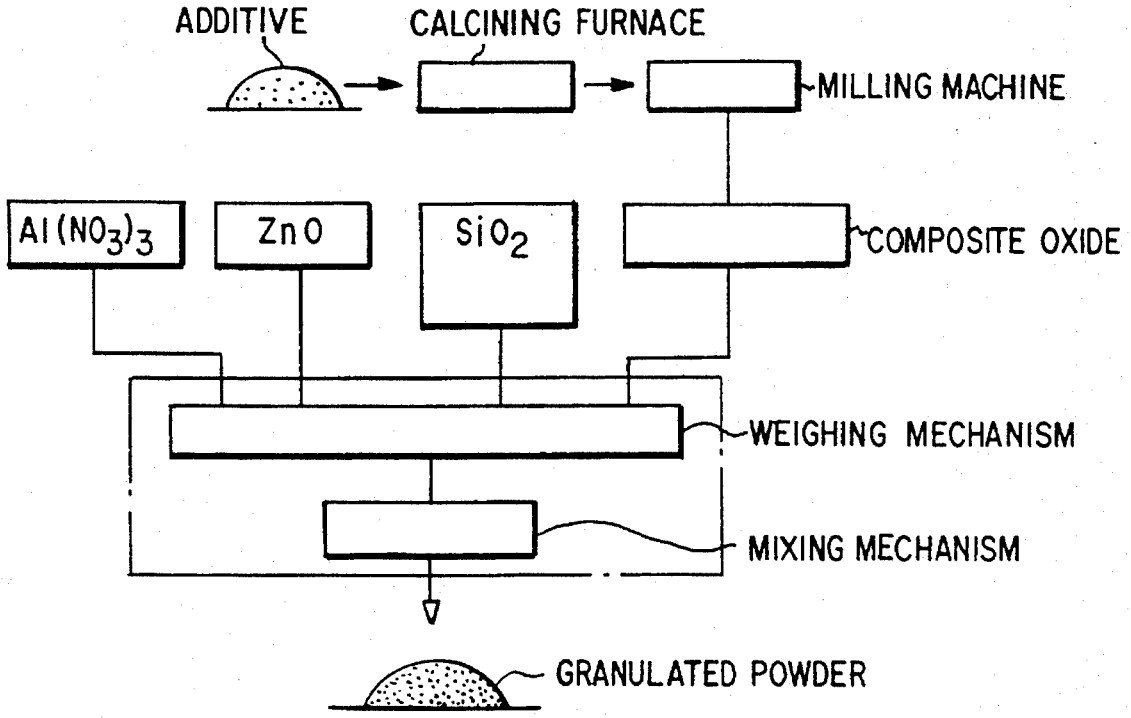
FIG. 14 is an explanatory chart showing a granular powder fabricating apparatus in accordance with the present invention.

An apparatus for fabricating granular powder has been manufactured. The apparatus comprises a mechanism for weighing a composite oxide, which is obtained as a starting raw material by weighing given amounts of additives such as $Bi_2O_3$, $Sb_2O_3$, $MnCO_3$, $Co_2O_3$, $Cr_2O_3$, NiO, $B_2O_3$, $SiO_2$ and so on and calcining and milling the additives, and $SiO_2$, a mechanism for mixing the weighed composite oxide and $SiO_2$, a mechanism for weighing ZnO and $Al(NO_3)_3$, and a mechanism for mixing mixed powder of the composite oxide and the $SiO_2$ and mixed powder of ZnO and $Al(NO_3)_3$ to fabricate granular powder. FIG. 14 schematically shows the apparatus for fabricating granular powder. Suitable granular powder can be fabricated using the apparatus.

Figure 15:
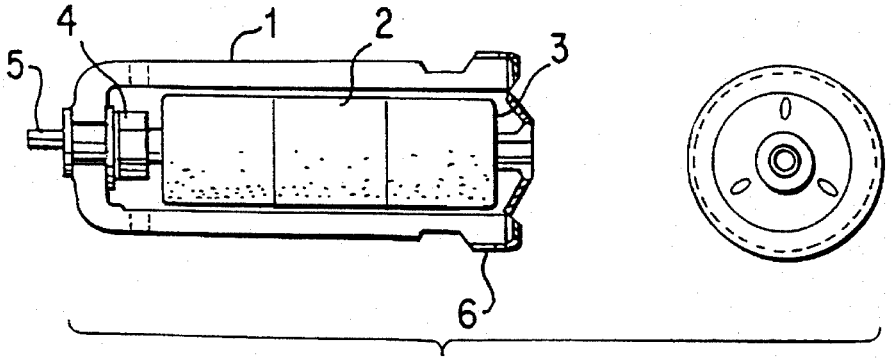
FIG. 15 is a schematic view showing the structure of an arrester using voltage non-linear resistance bodies in accordance with the present invention.

An arrester, shown in FIG. 15 emersed into oil in an AC 8.4 KV transformer is manufactured by baking glass on the side surface of and forming the top and bottom surfaces of elements fabricated under the same condition as the elements fabricated in Example 4 (element indicating the characteristic (G) in FIG. 11), laminating three of the elements and containing them into an insulator tube. In FIG. 15, the numeral 1 is an insulator tube, the numeral 2 being a voltage non-linear resistance body, the numeral 3 being a metallic plate, the numeral 4 being a metallic nut, the numeral 5 being an electrode terminal, the numeral 6 being a metallic cap. The life guarantee of the arrester may be 100 years under a condition of practical use from the results of the life time characteristic of the element.

Figure 18:
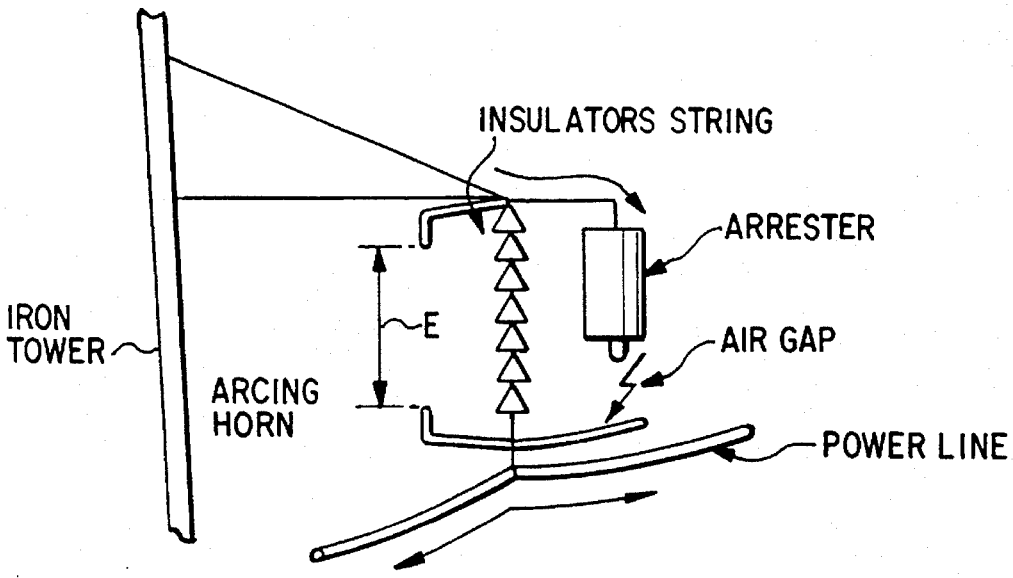
FIG. 18 is a schematic view depicting a power transmission line assembly with an arrester of ZnO elements according to the present invention.

In the arrester of FIG. 18, the glass was produced and applied as follows. Crystallized glass powder having a low melting point ($PbO$-$Al_2O_3$-$SiO_2$ group) is suspended in ethylcellulose-butylcarbitol solution, and the solution was applied to side surface of the sintered body with a brush to be 50–300 μm thick. The sintered body with the applied glass powder was treated thermally at 500° C. for 30 minutes in air for baking the glass. The sintered body being baked with the glass was polished at both ends with a lap-master by about 0.5 mm deep, and then was washed with trichloroethylene. Electrodes made of aluminum were formed respectively at both ends of the washed sintered body by a thermal spraying method.

A mixture containing $SiO_2$ mixed alone of 1.5 Mol. % in accordance with Example 2 above was used to fabricate resistors. The glass coating method as described in FIG. 15 preferably also was used for these resistors. The resistors can be applied in practical usage to various arresters as explained below:

(A) Gas Insulated Tank Type Arresters:

Protection for insulation among poles of gas insulated switching devices (GIS), circuit breakers (CB), and disconnecting switches (DS) against surges caused by close lightening strikes can be accomplished by installing zinc oxide type arresters at a service entrance of power lines.

A range of protecting arresters is broadened by installing the gas insulated tank type arrester at a service entrance of 275 kV GIS power lines. Further, installing the gas insulated tank type arrester at a lower portion of bushing of tank type arrester for three phase block type 275 kV lines is a fundamental for coordination of GIS insulation.

Figure 16:
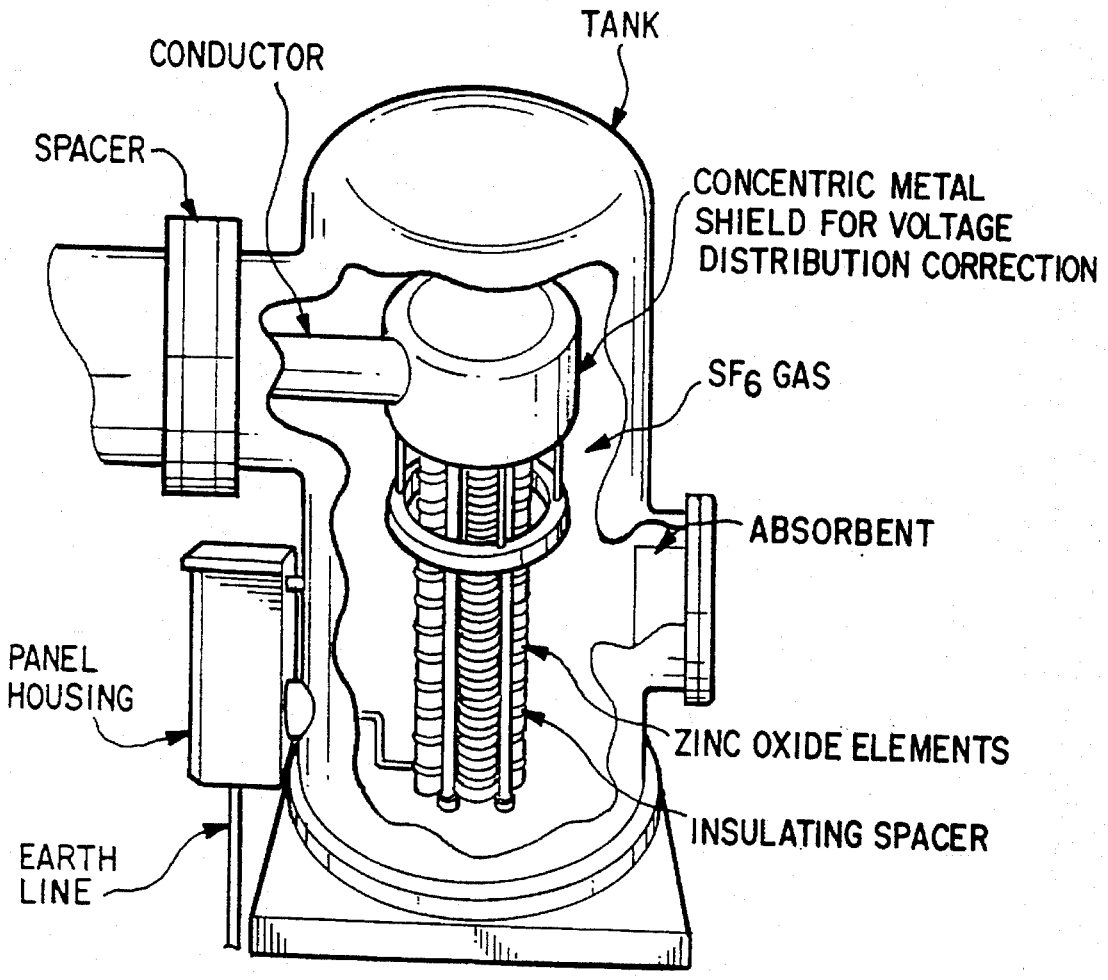
FIG. 16 is a schematic, partially cut-away sectional view of an insulated switching device with ZnO elements according to the present invention.

FIG. 16 is a perspective view of internal structure of an arrester for a 500 kV gas insulated switching device. Zinc oxide elements shaped like doughnuts are piled in series, and after being fixed with insulated supporting bars and an insulating cylinder, the elements are placed in a gas atmosphere.

The maximum advantage of using zinc oxide type arrester is in a point that lightening surges can be controlled arbitrarily by installing the arrester at various places in a transforming station. Lightening surge voltage can be restricted within a value of lightning impulse withstand voltage (LIWV) by installing the arresters at a service entrance, main bus-lines terminals, and transformer side. When the bus-lines spread wide depending on the size of the transforming station, the tank type arresters are installed even at the bus-line side.

At a 500 kV transforming station, conventional lines interval in the station of 34 m/line can be reduced to 27 m/line by applying zinc oxide type high performance arresters of the type contemplated by the present invention.

By applying zinc oxide tank type arrester units to 500 kV GIS, switching surge in 500 kV power Lines system can be controlled, and consequently, insulating level of power lines can be lowered.

B. Direct Connecting to Transformer Tank Type Arresters:

There are some cases when short time overvoltage (TOV) generates in a system as an oscillating overvoltage which continues from tens of milliseconds to a few seconds. The above cases are caused when frequencies of inductance component and capacitance component of the system are close to commercial frequency at a time such as one-line earthing, load dumping, and cable charging through a transformer. TOV at the commercial frequency in the system can be controlled by installing zinc oxide type arresters of the type contemplated by the present invention.

C. AC/DC Converting Stations:

Zinc oxide type arresters of the type contemplated by the present invention for AC/DC converting station having superior protecting characteristics are applied to AC/DC converting stations. The number of thyrister bulb elements in a series can be reduced to approximately 70% by use of the zinc oxide arrester.

Figure 17:
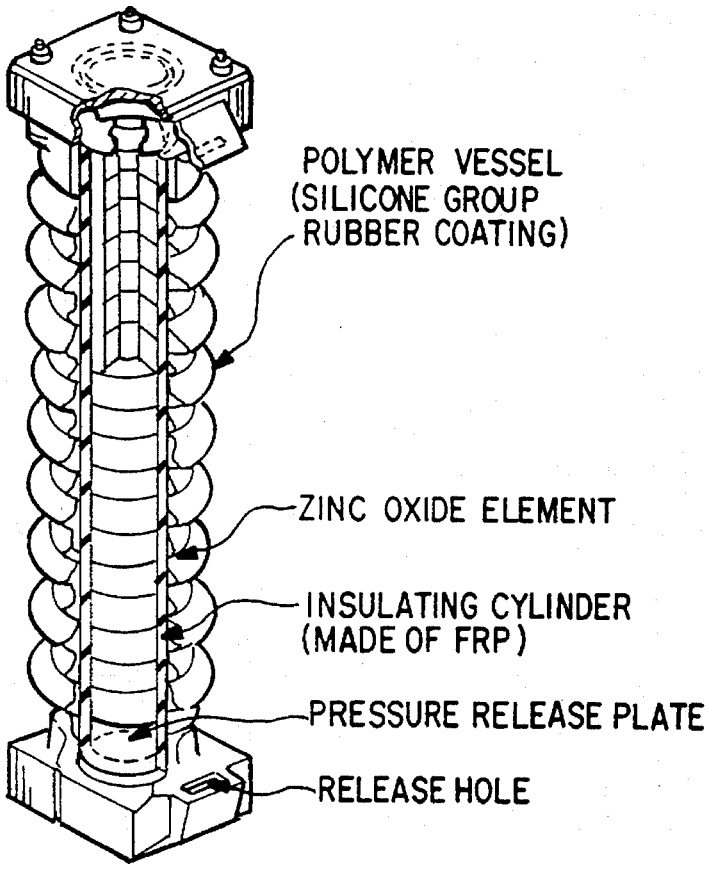
FIG. 17 is a schematic, partially cut-away sectional view of a thyristor bulb system with ZnO elements according to the present invention.

Transient current accompanied with commutating oscillation flows through an arrester for thyrister bulb shown in FIG. 17. Further, as the arrester for the thyrister bulb is insulated to the earth, manual measurement of leak current with an earth line as for a conventional arrester for AC current cannot be performed in view of safety. Therefore, methods for determining deterioration of the arrester by monitoring the arrester's temperature, and by monitoring the increase of leak current as intermittent pulses accompanied with commutating oscillation voltage are developed.

D. Power Transmission Lines:

The major part of failure on overhead power transmission lines is caused by lightening because flashover is generated when a voltage between horns exceeds a discharging voltage of the arcing horn by lightening stroke. In relation to a withstand voltage of suspension insulator string, main issue is for 66–154 kV system. The flashover failure can be prevented by installing arresters for power transmission.

Figure 19:
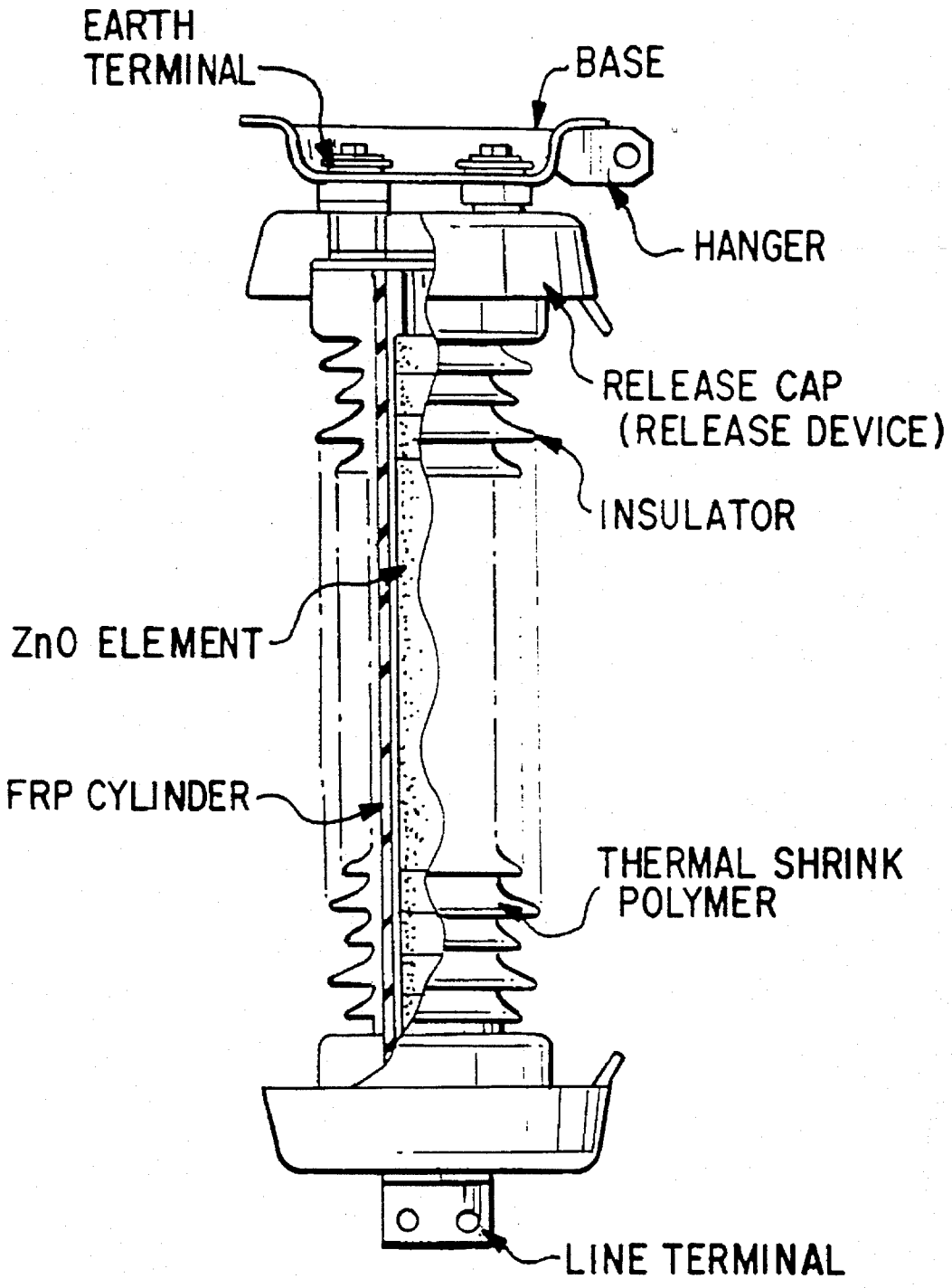
FIG. 19 is a schematic view of an arrester for power transmission utilizing ZnO elements according to the present invention.

The arrestor for power transmission comprises air single gap in series and lightning conducting elements including zinc oxide elements internally. FIG. 18 indicates an installing state of an arrester at a power transmission line. FIG. 19 indicates a composition of arrester for power transmission. The air single gap in series discharges at a voltage lower than a discharging voltage of the arcing horn, and releases lightening surge current. Dynamic current is interrupted depending on limiting voltage-current characteristics of the zinc oxide elements which are included inside the lightning conducting element, and an operation is completed.

Figure 20:
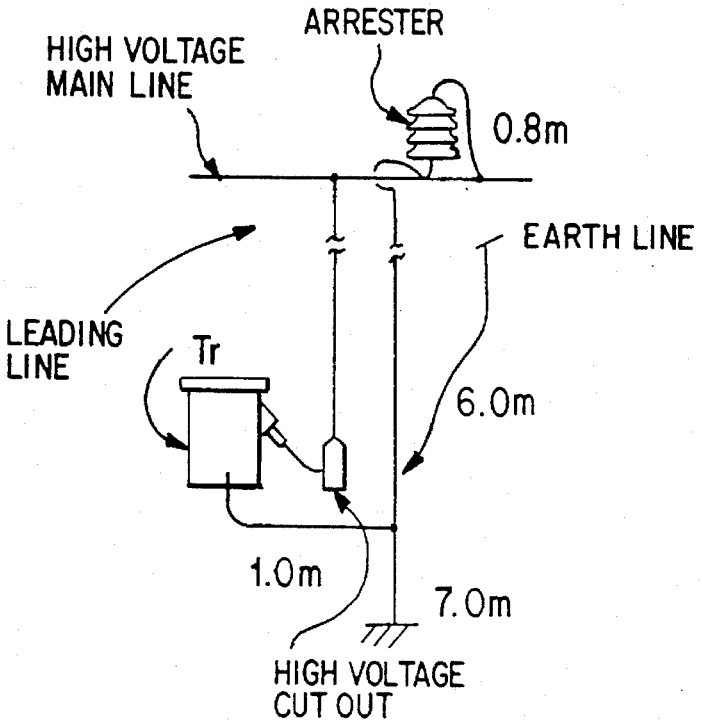
FIG. 20 is a schematic illustration of an arrester assembly at a high voltage main line power system distribution system, utilizing ZnO elements according to the present invention.
Figure 21:
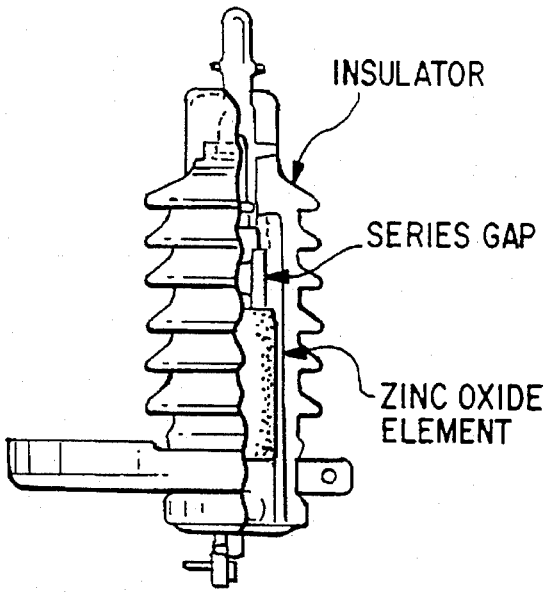
FIG. 21 is a schematics partially cut-away sectional view of an insulator type arrester for power distribution, utilizing ZnO elements according to the present invention.

E. Power Distribution Systems:

In order to protect power distributing lines against lightening surge in the system of FIG. 15, arresters for power distribution are installed at an interval of 200–250 m in a 6 kV power distributing system. FIG. 20 indicates an installing state at a high voltage main line of an insulator type arrester for power distribution wherein a simple gap in series and zinc oxide elements as for characteristic elements are combined. FIG. 21 indicates a composition of the insulator type arrester for power distribution. In some cases, a high voltage cutout which is installed in the vicinity of a pole transformer is connected to the simple gap in series and zinc oxide elements or zinc oxide type arrester.

According to the present invention, it is possible to provide a ZnO element and an arrester high in limiting voltage and excellent in withstanding discharge capacity characteristic and in voltage applying life time characteristic, since a twice-heat-treating method is realized by optimizing the fabricating processes for mixing the composite oxide and mixing the composite oxide with $SiO_2$, and for granulating and compacting the mixture, and by optimizing the combination of re-heating temperature and cooling speed after sintering of ZnO element.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of manufacturing a voltage nonlinear resistor comprising the following sequential steps:

preparing a calcinated mixture of metallic oxides which form mainly grain boundaries when mixed with and reacted with zinc oxide, forming a composite mixture by mixing said calcinated mixture of metal oxides with zinc oxide as a main component and with a grain growth suppressing oxide which suppresses grain growth of zinc oxide when sintered, granulating said composite mixture to form a granulated mixture, and sintering said granulated mixture.

2. A method according to claim 1, wherein said preparing a calcinated mixture includes providing metallic oxides including $Bi_2O_3$, $Sb_2O_3$, $MnCO_3$, $Cr_2O_3$, $Co_2O_3$ and $B_2O_3$.

3. A method according to claim 2, wherein said grain growth suppressing oxide is $SiO_2$.

4. A method according to claim 1, wherein said preparing a calcinated mixture includes providing metallic oxides including $Bi_2O_3$, $Sb_2O_3$, $MnCO_3$, $Cr_2O_3$, $Co_2O_3$, $B_2O_3$ and $SiO_2$.

5. A method according to claim 4, wherein said grain growth suppressing oxide is $SiO_2$.

6. A method according to claim 1, wherein said grain growth suppressing oxide is $SiO_2$.

7. A method according to claim 6, wherein said preparing a calcinated mixture includes calcining said metallic oxides together at a calcining temperature of 800°–1000° C. in local atmosphere.

8. A method according to claim 6, wherein said grain growth suppressing oxide is mixed in an amount between 1% and 50% by total weight of the calcinated mixture of metallic oxides.

9. A method according to claim 1, wherein said preparing a calcinated mixture includes calcining said metallic oxides together at a calcining temperature of 800°–1000° C. in local atmosphere.

10. A method according to claim 1, wherein said grain growth suppressing oxide is mixed in an amount between 1% and 50% by total weight of the calcinated mixture of metallic oxides.

11. A method according to claim 1, wherein the components of the resistor are in the following ranges of proportions:

| | |
|---|---|
| $Bi_2O_3$ = 0.1–3.0 Mol. % | 0.53–16.0% by weight |
| $Co_2O_3$ = 1.0–3.0 Mol. % | 0.19–5.71% by weight |
| $MnO_2$ = 0.1–3.0 Mol. % | 0.13–4.0% by weight |
| $Sb_2O_3$ = 0.1–3.0 Mol. % | 0.33–10.0% by weight |
| $Cr_2O_3$ = 0.05–1.15 Mol. % | 0.09–2.62% by weight |
| NiO = 0.1–3.0 Mol. % | 0.09–2.57% by weight |
| $SiO_2$ = 0.1–10.0 Mol. % | 0.07–6.89% by weight |
| $B_2O_3$ = 0.005–3.0 Mol. % | 0.004–0.24% by weight |
| $Al(NO_3)_3$ = 0.0005–0.025 Mol. % | 0.001–0.06% by weight |
| ZnO = | 98.56–51.91% by weight |

12. A method according to claim 1, wherein the components of the resistor are in the following ranges:

| | | |
|---|---|---|
| $Bi_2O_3$ = 0.4 | – | 1.0 Mol. % |
| $Co_2O_3$ = 0.5 | – | 1.5 Mol. % |
| MnO = 0.2 | – | 0.8 Mol. % |
| $Sb_2O_3$ = 0.5 | – | 1.5 Mol. % |
| $Cr_2O_3$ = 0.2 | – | 0.8 Mol. % |
| NiO = 0.5 | – | 1.5 Mol. % |
| $SiO_2$ = 1.0 | – | 3.0 Mol. % |
| $B_2O_3$ = 0.05 | – | 0.2 Mol. % |
| $Al(NO_3)_3$ = 0.002 | – | 0.02 Mol. % |
| ZnO = Residual (desirably 89–96 Mol %), (preferably 90–94.5 Mol. %). | | |

13. A method according to claim 1, comprising attaching at lease one electrode to the resistor.

* * * * *